US005829608A

United States Patent [19]

Clerget

[11] Patent Number: 5,829,608

[45] Date of Patent: Nov. 3, 1998

[54] SEAL FOR A LID OR THE LIKE AND LID PROVIDED THEREWITH

[75] Inventor: Bernard Clerget, Haudivillers, France

[73] Assignee: Parfums Givenchy, Levallois-Perret, France

[21] Appl. No.: 750,875

[22] PCT Filed: Jun. 21, 1995

[86] PCT No.: PCT/FR95/00826

§ 371 Date: Mar. 19, 1997

§ 102(e) Date: Mar. 19, 1997

[87] PCT Pub. No.: WO95/35244

PCT Pub. Date: Dec. 28, 1995

[30] Foreign Application Priority Data

Jun. 22, 1994 [FR] France ..... 94 07670

[51] Int. Cl.[6] ..... B65D 1/02

[52] U.S. Cl. ..... 215/44; 215/45; 215/277; 215/343; 220/256; 220/258

[58] Field of Search ..... 215/273, 276, 215/277, 320, 343, 354, 44, 45; 220/256, 258

[56] References Cited

U.S. PATENT DOCUMENTS

| | | | |
|---|---|---|---|
| 1,793,048 | 2/1931 | Brigel | 215/277 |
| 2,011,140 | 8/1935 | Berglund | 215/277 |
| 2,916,174 | 12/1959 | Orr | 215/277 |
| 3,924,772 | 12/1975 | Magnani . | |
| 5,143,236 | 9/1992 | Gueret | 215/311 |

FOREIGN PATENT DOCUMENTS

| | | |
|---|---|---|
| 1 197 452 | 12/1959 | France . |
| 2 260 507 | 5/1975 | France . |
| 85 24 966 | 1/1987 | Germany . |
| 37 43 522 | 7/1989 | Germany . |
| 742627 | 12/1955 | United Kingdom . |

*Primary Examiner*—Stephen Cronin
*Attorney, Agent, or Firm*—Pennie & Edmonds LLP

[57] ABSTRACT

A seal for a lid or the like and a lid provided therewith are disclosed. Said seal (5) for a lid (2) such as a screw top for the open end (1) of a container (R) consists of a disk or ring loosely fitted in the bottom of the lid (2) and comprises one surface (7) having a ring-shaped lip (8) with a substantially tapered bearing surface (9) compressively engaging a corresponding bearing surface (13) on the open end (1) of the container (R), and a second surface (10) having a circular raised portion (11) with a flat bearing surface (12) slidably engaging the bottom (3) of the lid (2). Said seal may be used in caps on containers for cosmetics.

6 Claims, 1 Drawing Sheet

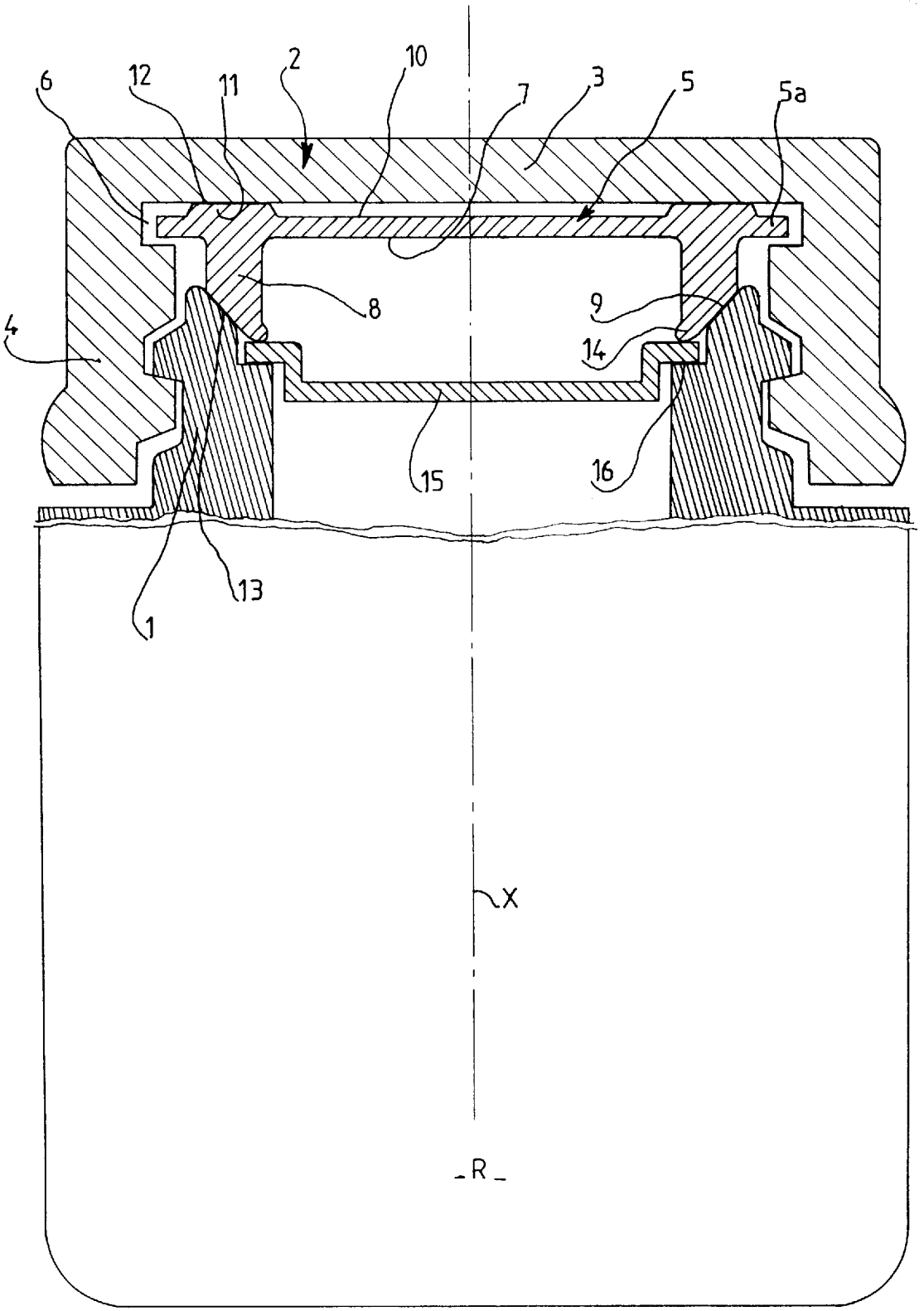
6
12
11
2
10
7
3
5
5a
8
9
4
14
15
16
13
1
X
R

SEAL FOR A LID OR THE LIKE AND LID PROVIDED THEREWITH

SUMMARY OF THE INVENTION

The present invention has essentially as its subject a self-centring seal intended to fit for example a container lid or cap.

It is also directed to a lid fitted with this seal as well as to a container comprising a lid provided with the said seal.

The fluid-tightness relative to the product contained in a container or to the vapor evolving from this product is generally obtained by compression of a seal accommodated in a capsule of the lid which may be screwed onto the open end of the container.

The seal is generally stuck or locked in the bottom of the lid, thereby leading to a certain number of inconveniences.

In effect, a great portion of the screwing torque is devoted to friction to the detriment of the compression of the seal hence of its fluid-tightness in particular in relation to the vapor.

This phenomenon is all the more substantial on those containers or pots as the diameter of the open end of which is large.

Moreover in case of surface or flatness defects of the open end of the pot, the seal may be hurt and its performances called in question again.

The present invention has as its object to remedy in particular the hereabove inconveniences by proposing a seal providing in any circumstances a good fluid-tightness, raising no problem of compatibility with the product in the container, remaining not very fragile, avoiding all problems inherent in frictions during the closing of the container and also solving all the problems of concentricity.

For that purpose, the invention has as its subject a seal for a lid or the like for example forming a cap which may be screwed upon the open end of any container whatsoever and of the type comprising a disk or a ring the periphery of which is provided with projecting means adapted to ensure the fluid-tightness through compression of the seal upon the open end of the container, characterized in that the said projecting means are constituted by an annular lip projecting from one face of the disk or ring and exhibiting at its end a substantially tapered bearing face.

According to a preferred embodiment, the substantially conical bearing face of the aforesaid lip converges towards the axis of the disk or ring in a direction away from the plane of the latter.

This seal is further characterized in that the other face of the aforesaid disk or ring exhibits plumb with the aforesaid lip an annular boss the bearing face of which exhibits the shape of a flattening.

The invention is also directed to a lid forming for example a cap which may be screwed upon any container or pot whatsoever and fitted with a seal meeting the hereabove characteristics, this lid being characterized in that the said seal is mounted in floating relationship in substantially parallel relation to the bottom of the lid into an annular groove of this lid the width of which is slightly greater than the thickness which the aforesaid disk or ring and the aforesaid boss are forming.

According to still another characteristic of this lid, when one screws it upon the container, the aforesaid tapered bearing face of the lip of the seal co-operates with a corresponding and complementary bearing face forming the open end of the container.

One should further remark here that that portion of the tapered bearing face of the seal which is closest to the axis of the aforesaid disk or ring is bearing upon a closing disk retained upon a shoulder provided on the open end of the container.

The seal as well as the container are made from polyolefin such as polypropylene for example whereas the lid is made from a styrene-acrylonitrile copolymer to permit a relative sliding of the seal with respect to the said lid.

This lid may be of the type with an oriented sealing through screwing over a quarter of a turn for example.

But further characteristics and advantages of the invention will appear better in the detailed description which follows and refers to the single attached drawing given by way of example only and showing in part and in axial section a container closed by a lid or cap provided with a seal according to the present invention.

BRIEF DESCRIPTION OF THE DRAWING

FIG. 1 is a cross-sectional view of a seal and lid according to the present invention.

DETAILED DESCRIPTION OF THE PREFERRED EMBODIMENT

On the attached single FIGURE one sees a container R the open and externally threaded end 1 of which is closed by a lid or cap 2 comprising a bottom 3 and an internally threaded skirt 4 permitting the screwing or the unscrewing of the said cap upon the open end 1 of the container R.

According to the invention, a seal 5 is mounted in floating relationship within the cap 2, in substantially parallel relation to its bottom 3 and this owing to an annular groove 6 formed between the said bottom 3 and the skirt 4 of the cap 2.

As one sees it well on the single FIGURE, the seal 5 is retained with its periphery 5*a* within the annular groove 6.

This seal 5 according to the example shown presents itself in the shape of a disk of flexible synthetic material one 7 of the faces of which comprises an annular lip 8 projecting from the face 7 and the end of which forms a substantially conical bearing face 9.

The bearing face 9 as it clearly appears on the FIGURE converges towards the axis of the seal 5 which coincides with the axis of the cap 2 and this in a direction extending away from the plane of the seal 5.

One could perfectly without departing from the scope of the invention provide a bearing face 9 converging towards the axis X but in a direction extending towards the plane of the seal 5.

The other face 10 of the seal 5 in the shape of a disk or which could well also be ring-shaped comprises an annular boss 11 the face 12 of which bearing upon the bottom 3 of the cap 2 exhibits the shape of a flattening.

Thus as one may understand it, the width or height of the annular groove 6 in the cap 2 will be slightly greater than the thickness formed by the periphery 5*a* of the disk 5 and the circular boss 11 so that the seal 5 be retained in a floating manner in the cap 2.

The open end 1 of the container R comprises a tapered bearing face 13 corresponding to and complementary of the conical bearing face 9 of the circular lip 8 projecting from the face 7 of the seal 5.

Furthermore the end or top portion 14 of the tapered bearing face 9 of the annular lip 8 is bearing as one sees it well on the FIGURE upon a closing disk 15 which is retained upon a shoulder 16 provided on the open end 1 of the container R.

Such a closing disk could of course be omitted without departing from the scope of the invention.

According to a preferred embodiment of the invention, the materials constituting the cap 2 and quite particularly the bottom 3 on the one hand and the seal 5 on the other hand are so selected that they provide a sliding co-operation between these two elements.

The container R or at the very least its open end 1 could be made from a polyolefine such as polypropylene for example as well as the seal 5, this in a manner as to permit a fluid-tight bearing and clinging between the annular lip 8 and the open end 1 of the container R.

The cap 2 as to the latter may be made from a styrene-acryonitrile copolymer to which could possibly be added a sliding-promoting agent such as silicon for example to allow a sliding of the seal 5 or more precisely of the circular boss 11 of this seal upon the bottom 3 of the cap 2.

One therefore understands from the description which precedes that during the screwing of the lid or cap 2 upon the open head 1 of the container R for closing it, there will occur a relative sliding avoiding any seizing and any deterioration between the bottom 3 of the cap 2 and the circular boss 11 belonging to the seal 5, so that the co-operation between the conical bearing faces 9 and 13 will essentially result from a compression force applied by the cap 3 during screwing and thus with a friction reduced to a minimum between these two faces, so that the fluid-tightness achieved at the interface will be maximum.

Moreover this fluid-tightness will be obtained for a minimum screwing rotation of the cap or lid 3 so that the said cap could be advantageously used for providing an oriented closure, i.e. a closing effected by a screwing over one quarter of a turn for example of the cap. This is useful when the cap exhibits for example a square shape which should during closing coincide with the square shape of the container R.

In this case, it is of course the annular orientation of the cap which will determine the compression force of the lip 8 of the seal 5 upon the open head 1 of the container R.

One should further remark that with a sealing system according to the present invention, not only the frictions are reduced to a minimum or even avoided but any problem of concentricity between the threadings and the sealing area is advantageously avoided.

The invention is of course not at all limited to the embodiment described and illustrated which has been given by way of example only.

Thus the materials used in the manufacture of the cap, of the seal and of the container closable with the cap may be other than those presently described. In this range of concepts, the closure disk which supplements the seal may be omitted.

This means that the invention comprises all the technical equivalents of the means described as well as their combinations if the latter are effected according to its gist.

I claim:

1. In combination, a container having an open end and a shoulder adjacent thereto; a lid forming a cap on the open end of the container and having a longitudinal axis; a seal associated with the lid and having a body and an annular lip projecting therefrom, the lip having a substantially tapered bearing face which converges towards the longitudinal axis of the lid in a direction extending away from the body; and a closure disk seated on shoulder of the container open end; wherein the open end of the container is configured and dimensioned to have a corresponding and complementary bearing face to that of the annular lip of the seal so that, when the cap is closed on the container, the seal is compressed and the bearing face of the seal contacts the bearing face of the open end of the container, with a portion of the bearing face of the annular lip of the seal bearing upon the closure disk to retain the closure disk on the shoulder of the open end of the container.

2. The combination of claim 1 wherein the lid has an annular groove and the body of the seal has a periphery which is mounted in the annular groove.

3. The combination of claim 1 wherein the seal body is a disk or ring.

4. The combination of claim 1 wherein the seal is made of a polyolefin and the lid is made of a styrene-acrylonitrile copolymer to permit relative sliding of the seal with respect to the lid.

5. The combination of claim 4 wherein the seal is made of polypropylene.

6. The combination of claim 1 wherein the open end of the container includes outer threads and the lid includes mating internal threads with the lid being screwed onto the container to close the open end.

* * * * *